US008704740B2

(12) United States Patent
Wang

(10) Patent No.: US 8,704,740 B2
(45) Date of Patent: Apr. 22, 2014

(54) METHOD OF ESTABLISHING A GAMMA TABLE

(75) Inventor: Jian-Feng Wang, Shenzhen (CN)

(73) Assignees: Innocom Technology (Shenzhen) Co., Ltd., Shenzhen, Guangdong Province (CN); Chimei Innolux Corporation, Miaoli County (TW)

( * ) Notice: Subject to any disclaimer, the term of this patent is extended or adjusted under 35 U.S.C. 154(b) by 1078 days.

(21) Appl. No.: 12/720,785

(22) Filed: Mar. 10, 2010

(65) Prior Publication Data

US 2011/0057944 A1 Mar. 10, 2011

(51) Int. Cl.
*G09G 3/36* (2006.01)

(52) U.S. Cl.
USPC ..... 345/89; 345/88; 345/690; 345/590; 382/266

(58) Field of Classification Search
USPC ..... 345/88–89, 102, 590, 690; 382/167, 382/169, 254, 260–266, 274, 107
See application file for complete search history.

(56) References Cited

U.S. PATENT DOCUMENTS

2002/0011979 A1* 1/2002 Nitta et al. ..... 345/89
2002/0118875 A1* 8/2002 Wilensky ..... 382/173
2008/0180375 A1* 7/2008 Wang ..... 345/89

* cited by examiner

*Primary Examiner* — Lun-Yi Lao
*Assistant Examiner* — Md Saiful A Siddiqui
(74) *Attorney, Agent, or Firm* — WPAT, PC; Justin King

(57) ABSTRACT

An exemplary embodiment of method of establishing a gamma table using a system includes following steps. Providing a signal generator, a display device, and a color analyzer, consists of measuring luminance values of the images corresponding to a plurality of reference sampling points. Obtaining a luminance characteristic curve based on the reference sampling points and luminance values using Bezier curve interpolation. Locating the gray scales on the luminance characteristic curve with the same luminance values as the gray scales of a standard gamma table. And establishing a gamma table by comparing the gray scales of the standard gamma curve and the luminance characteristic curve.

9 Claims, 7 Drawing Sheets

METHOD OF ESTABLISHING A GAMMA TABLE

BACKGROUND

1. Technical Field

The disclosure generally relates to gamma table generation, and particularly to a method of establishing a gamma table for a display device.

2. Description of the Related Art

Gamma tables are generally established in display devices such as liquid crystal displays (LCDs), since each display device has a different panel, with a correspondingly different gamma curve. Gamma tables may be obtained by testing different display devices, and integrating the results into the display device in the form of firmware. However, in such cases, the gamma curve can not be optimally adjusted according to individual characteristics. Moreover, the gamma table is obtained after testing and calculating quantities of experimental data from different display devices, increasing time and cost requirements.

To establish a gamma table, a luminance characteristic curve is required. Luminance values for 1024 gray scales are measured, and connected to generate the luminance characteristic curve. However, measurement and calculation for the 1024 gray levels can be slow, and the resulting measurement data may occupy considerable memory resources. To speed up measurement and computation, a small number of gray levels can be measured and sampled among the total number of 1024 gray levels, with the luminance characteristic curve established by interpolation. However, interpolated luminance characteristic curves generally differ considerably from the standard gamma curve.

Therefore, there is room for improvement within the art.

BRIEF DESCRIPTION OF THE DRAWINGS

Many aspects of a method of establishing a gamma table can be better understood with reference to the following drawings. The components in the drawings are not necessarily drawn to scale, the emphasis instead being placed upon clearly illustrating the principles of the exemplary method of establishing a gamma table. Moreover, in the drawings, like reference numerals designate corresponding parts throughout the several views. Wherever possible, the same reference numbers are used throughout the drawings to refer to the same or like elements of an embodiment.

DETAILED DESCRIPTION

Figure 1:
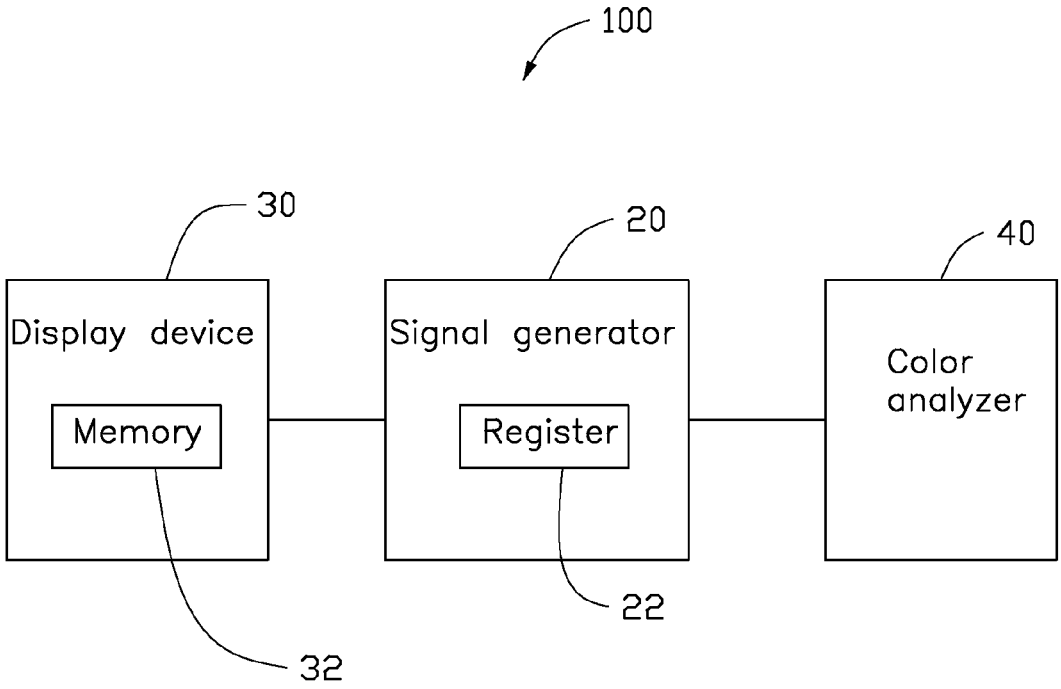
FIG. 1 is a block diagram of a test system executing a method of establishing a gamma table, the method according to an exemplary embodiment.

FIG. 1 is a block diagram of a test system 100 for executing a method of establishing a gamma table according to an exemplary embodiment. The test system 100 includes a signal generator 20, a display device 30, and a color analyzer 40; with the signal generator 20 respectively connected to the display device 30 and the color analyzer 40. The signal generator 20 sequentially provides a plurality of gamma voltage signals to the display device 30 to generate images, and includes a register 22 for storing the different luminance values corresponding to the different gamma voltage signals. The display device 30 can be a LCD and includes a memory 32 for storing the gamma table. The color analyzer 40 determines the different luminance values of the images displayed on the display device 30, and provides the luminance values to the register 22 of the signal generator 20.

Figure 2A:
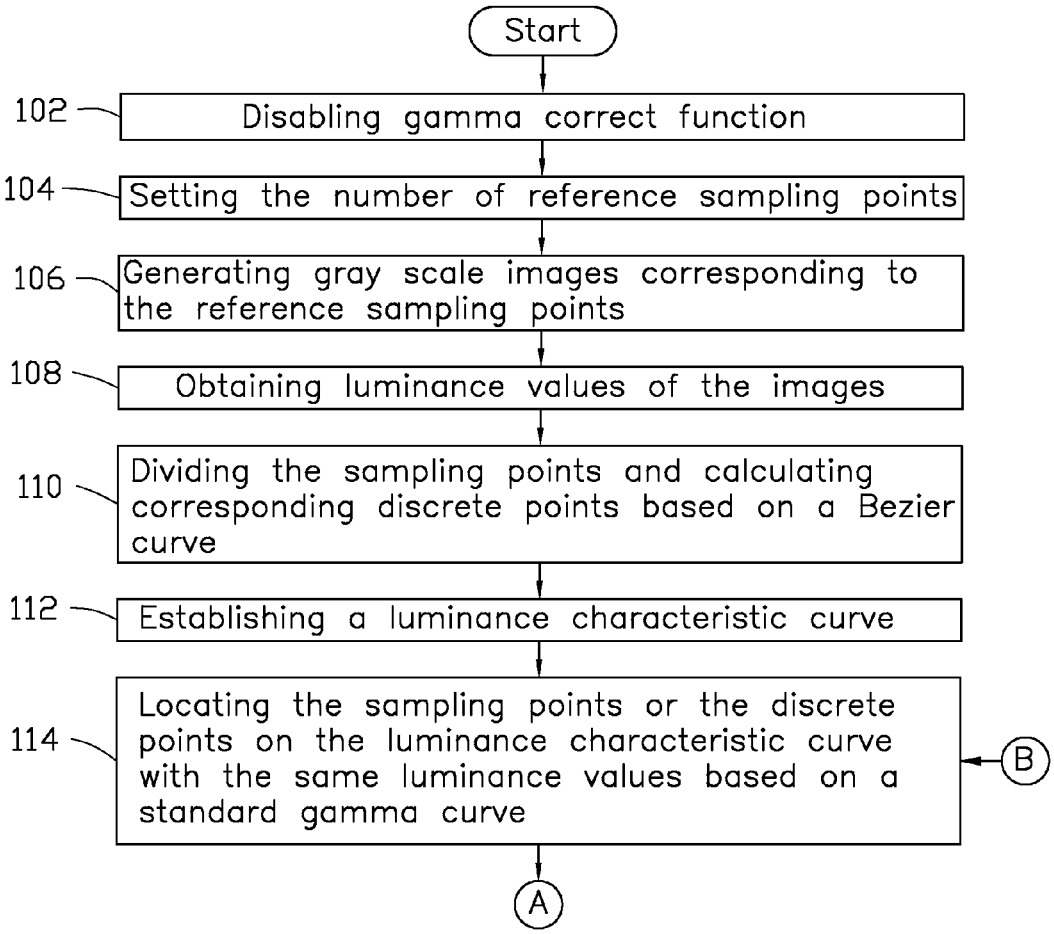
FIG. 2A and FIG. 2B are flowcharts illustrating a method of establishing a gamma table according to an exemplary embodiment of the disclosure.
Figure 2B:
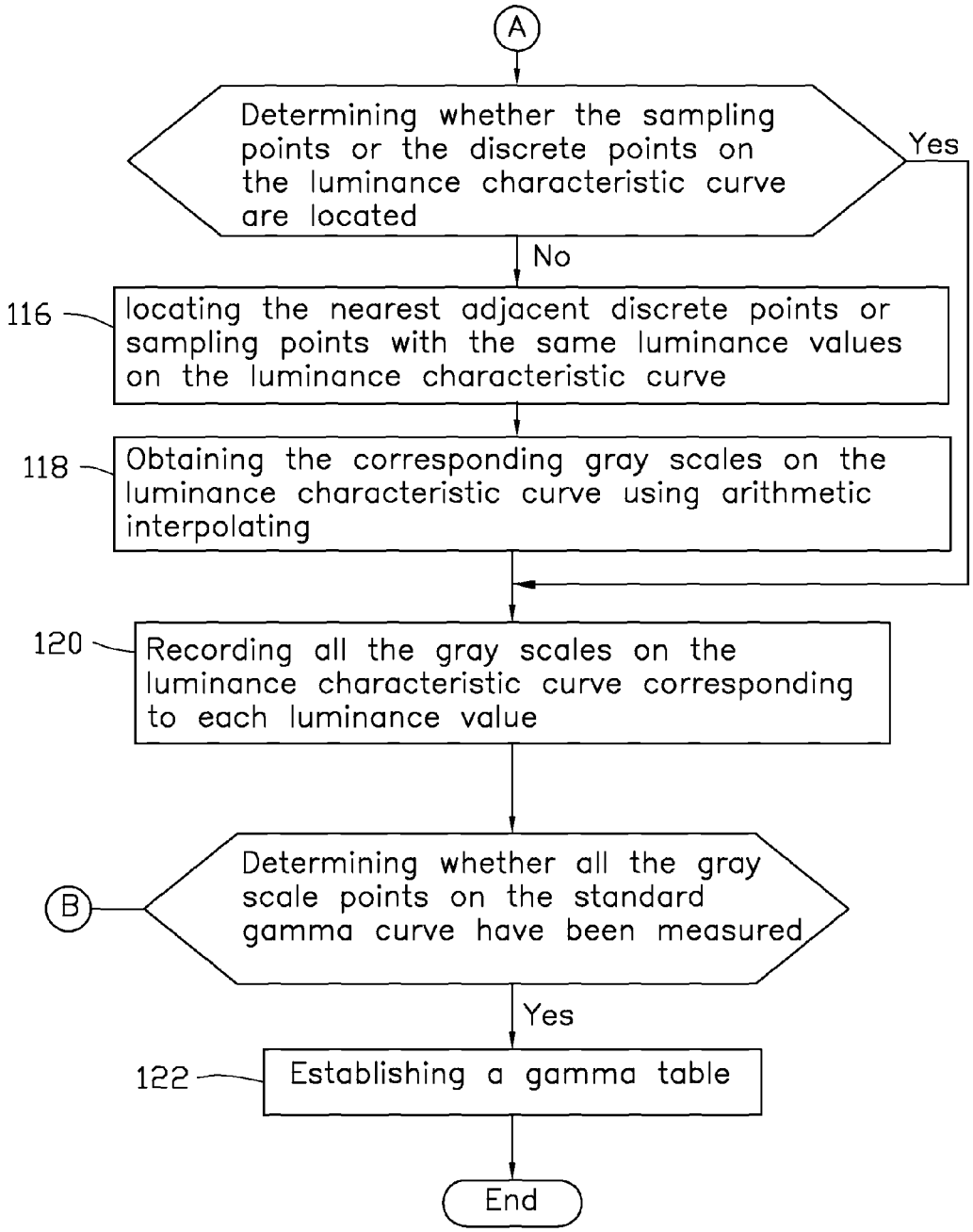

Further referring to FIG. 2, a method of establishing a gamma table according to an exemplary embodiment of the disclosure, including at least the following steps, is depicted.

In step S102, a gamma correction function of the display device 30 is temporarily disabled by an exterior circuit or an appropriate application, such that the gamma table correction function is not accessible before the display device 30 begins to obtain the native luminance values of the display device 30 in the subsequent sampling.

In step S104, the number of reference sampling points is set. In this exemplary embodiment, a total of 64 reference sampling points are set to increase computing speed and reduce memory resource usage. The reference sampling point 0 through the reference sampling point 63 respectively corresponds to gray scale 0, gray scale 4, gray scale 8, . . . , gray scale 248, and gray scale 252 of the single-color images of the display device 40. Moreover, the number of reference sampling points can also be set as 2, 4, 8, 16, 32, . . . , $2^n$, where n is a whole number, and $1 \le n \le 10$. For example, the number of reference sampling point can be set to 128 to improve accuracy, so that the reference sampling points respectively correspond to gray scale 0, gray scale 2, gray scale 4, . . . , gray scale 250, gray scale 252, and gray scale 254. This is accomplished by choosing M sampling points as control points from the reference sampling points which respectively correspond to a particular gray scale, where M is a whole number, and $3 \le M \le 2^n$, and $2 \le n \le 5$.

In step S106, single gray scale images are generated corresponding to multiple reference sampling points on the display device 40. In this exemplary embodiment, the signal generator 20 provides the gamma voltage signal corresponding to gray scale 0, gray scale 4, gray scale 8, . . . , gray scale 248, and gray scale 252, and generate corresponding images. The display device 30 receives and displays the images of the gray scales according to the gamma voltage signal.

In step S108, luminance values of the images displayed on the display device 30 are obtained and stored in the register 22. The luminance values of the gray scale images corresponding to the total 64 sampling points (namely, the luminance values corresponding to gray scale image 0, gray scale image 4, gray scale image 8, . . . , gray scale image 248, and gray scale image 252) are obtained by the color analyzer 40. The luminance values are then transferred to the register 22 of the signal generator 20, resulting from generating an initial luminance characteristic curve corresponding to the display device 30.

Figure 3:
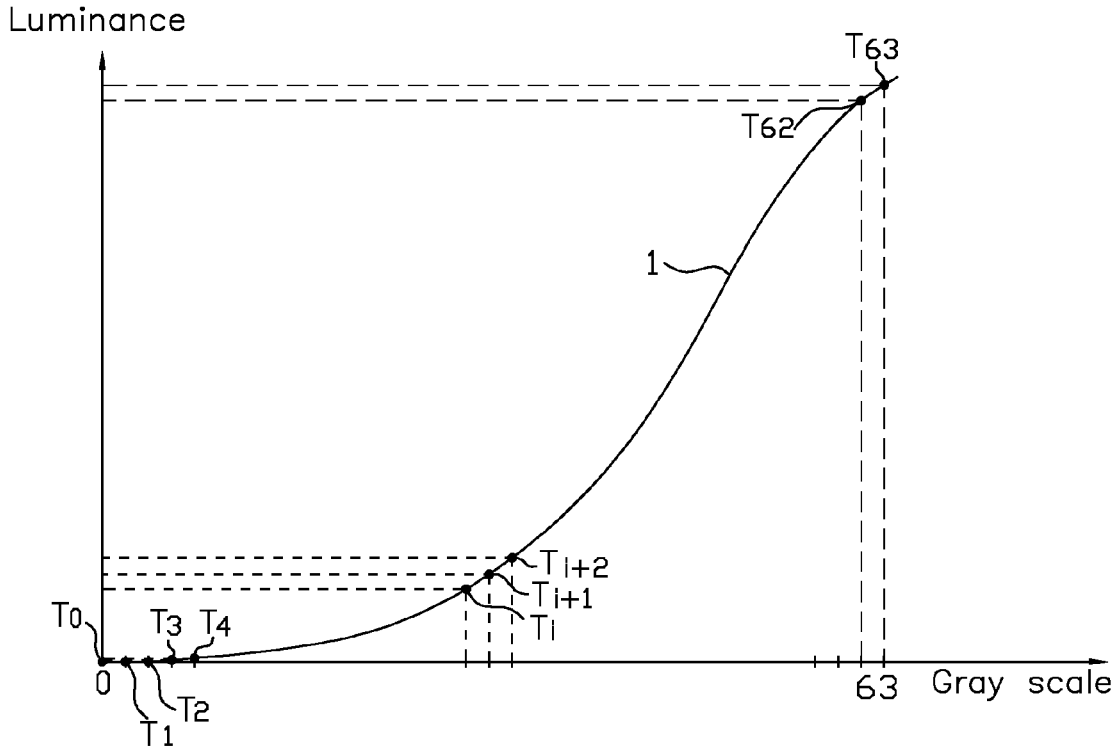
FIG. 3 is a schematic illustration of a relationship between reference gray scales (X-axis) and corresponding luminance values (Y-axis), showing generation of a luminance characteristic curve in accordance with the method shown in FIG. 2.

FIG. 3 shows the initial luminance characteristic curve 1 being obtained using the method of FIG. 2. In detail, horizontal coordinate values T of the luminance characteristic curve 1 represent different sampling points from 0 to 63 and beyond. Vertical coordinate values P of the luminance characteristic curve 1 represent different luminance values corresponding to the sampling points from 1 to 63 and beyond.

In step S110, the sampling points are divided and corresponding discrete points are calculated based on the Bezier curve. The sampling points are divided into multiple control groups, each including M (e.g., M=4) sampling points as control points (where M is a whole number, and $3 \leq M \leq 2^n$, and $2 \leq n \leq 5$), with the discrete points obtained by calculating the square root, the cube root, the fourth root, . . . , the M−1th root of the Bezier curve. In this exemplary embodiment, to obtain other non-sampling points for establishing the luminance characteristic curve 1, in detail, the total of 1024 points (including the previous 64 sampling points) of the luminance characteristic curve 1 is obtained using arithmetic interpolation. The 1024 points are evenly distributed in equal gray scale intervals.

As an example, if a total of 64 sampling points from 0 though 63 is divided into multiple control groups, and each control group includes 4 sampling points, the initial sampling point of any one control group is the same as the final sampling point of the previous successive control group. Thus, the sampling points are grouped as: the first control group: T0, T1, T2, and T3; the second control group: T3, T4, T5, and T6; the third control group: T6, T7, T8, and T9; . . . and so on.

Figure 4:
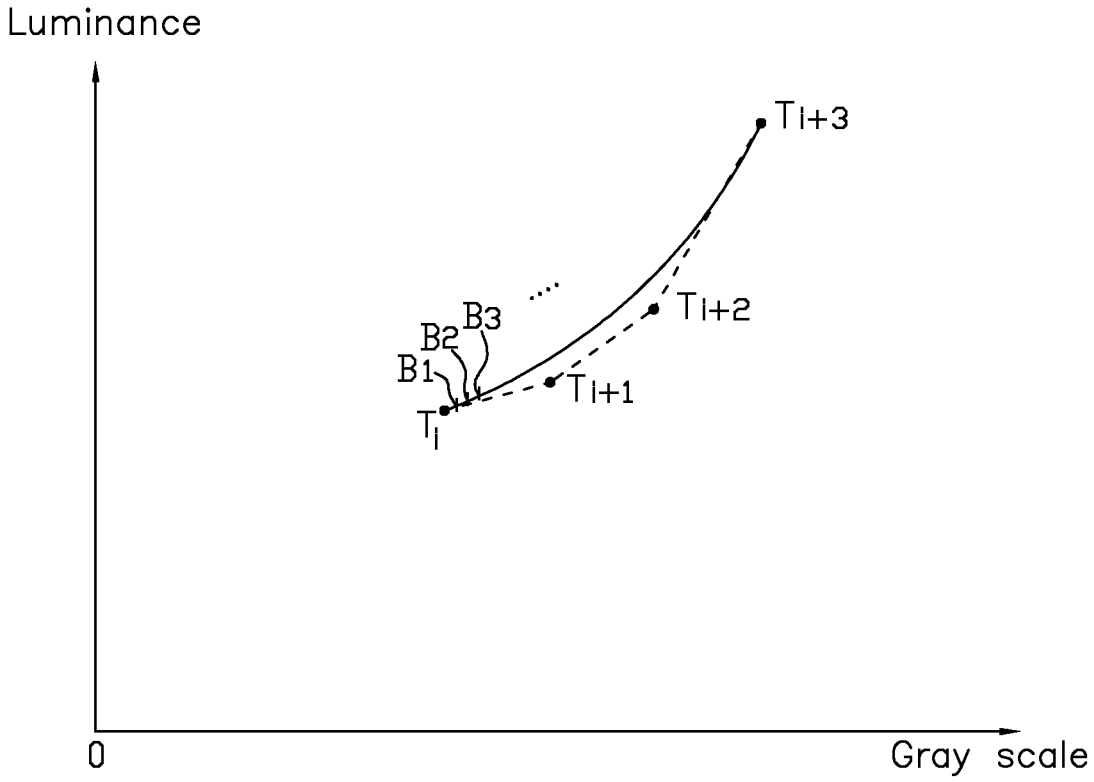
FIG. 4 is a schematic view of a Bezier curve and sampling points of an exemplary method of establishing a gamma table according to the disclosure.

Further referring to FIG. 4, any four sampling points Ti, Ti+1, Ti+2, and Ti+3 are calculated as the control points of the cubic Bezier curve to generate corresponding discrete points by the arithmetic interpolation. A line between the sampling point Ti and the sampling point Ti+1 is divided into 16 equal parts by 15 discrete points B1 through B15. Similarly, each line between every two successive sampling point is divided into 16 equal parts by 15 discrete points. Thus, a total of 960 discrete points are obtained, resulting in a total of 1024 gray scales when adding the previous 64 sampling points. Thus, the arithmetic interpolation is used to obtain the luminance values of the discrete points, which reduces the workload for obtaining 1024 gray scales as well as minimizing the burden on the memory resource of the register 22. Similarly, the total number of sampling points can be set to 32, 64, 128 and so on, with the number of samples in each control group 3 or more and not more than 32.

In step S112, a luminance characteristic curve is established by sequentially connecting all 960 discrete points and 64 sampling points, whereby a complete luminance characteristic curve of the display device 30, such as the luminance characteristic curve 1 in the FIG. 1, is determined and stored in the register 22 of the signal generator 20.

Figure 5:
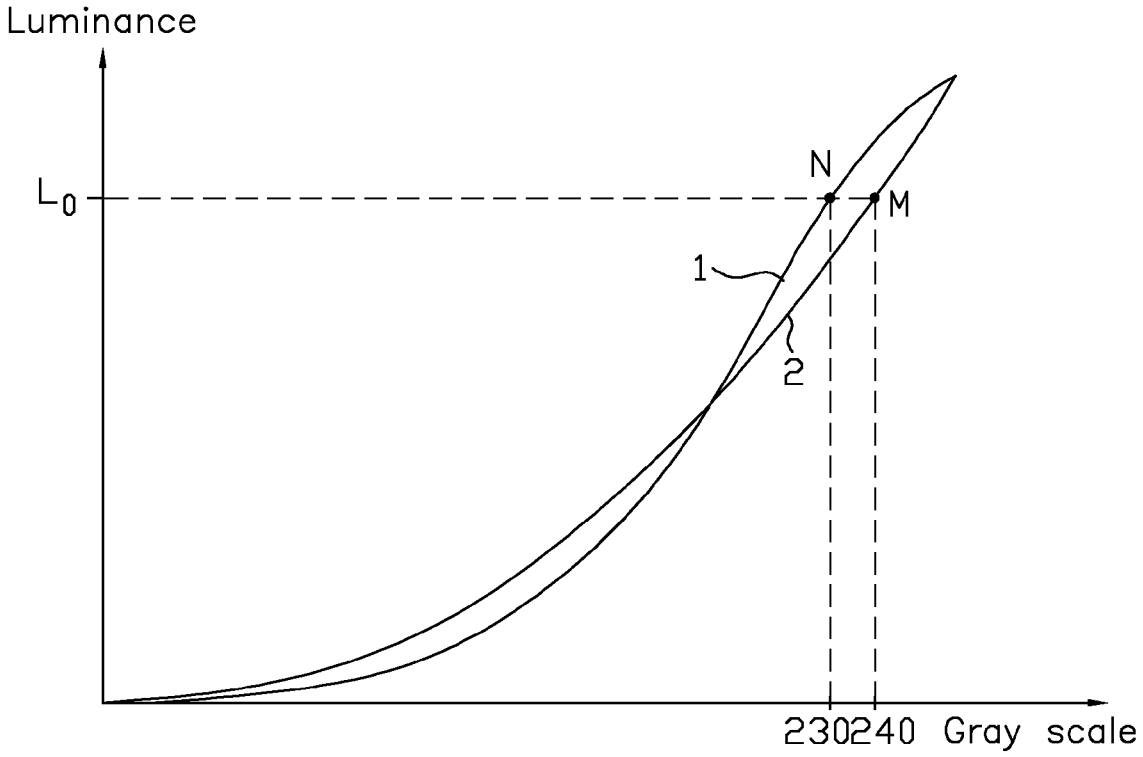
FIG. 5 is a schematic view showing generation of a luminance characteristic curve according to a standard gamma curve, in accordance with the method shown in FIG. 2.

In step S114, the sampling points or the discrete points on the luminance characteristic curve with the same luminance values are located based on a standard gamma curve. FIG. 5 shows the standard gamma curve 2, wherein the gray scales from 0 to 255 on the standard gamma curve 2 can be divided into 1024 location points in the same intervals. The location points can be measured from smallest to largest, whereby the gray scales on the luminance characteristic curve are obtained. For example, in FIG. 5, since the location point M on the standard gamma curve 2 has a gray scale value of 240 and luminance value of L0, the discrete point N having the same luminance value (L0) can be obtained on the luminance characteristic curve 1, showing a gray scale value of 230. If the sampling points or the discrete points on the luminance characteristic curve 1 are located, step 120 is implemented. If the sampling points or the discrete points on the luminance characteristic curve 1 are not located, step 116 is implemented.

In step S116, the nearest adjacent discrete points or sampling points with the same luminance values on the luminance characteristic curve are located.

Figure 6:
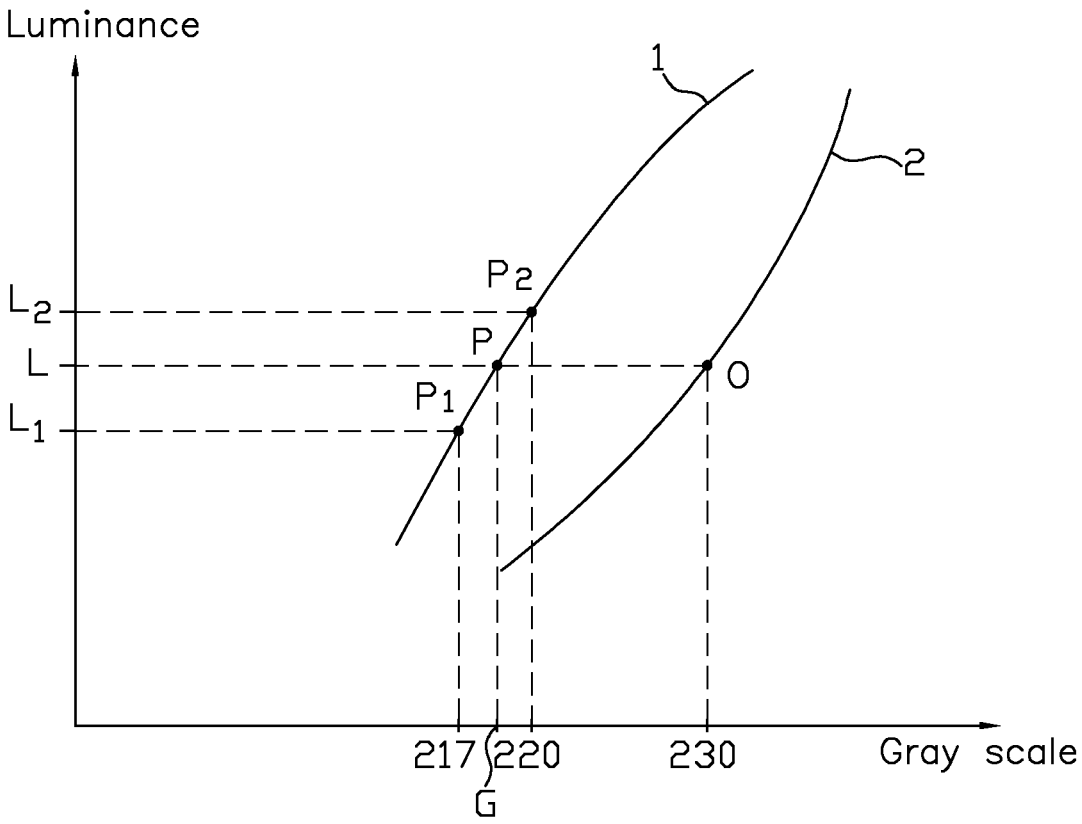
FIG. 6 is a schematic view showing determination of the location of the luminance characteristic curve according to arithmetic interpolation, in accordance with the method shown in FIG. 2.

In step S118, corresponding gray scales on the luminance characteristic curve are obtained using the arithmetic interpolation. Further referring to FIG. 6, the location point O on the standard gamma curve 2 shows a gray scale value of 230 and a luminance value of L, corresponding to a non-discrete point P on the luminance characteristic curve 1 showing the same luminance value L. Thus, the nearest discrete points P1 and P2 adjacent to the point P are used. Gray scale and the luminance value of the discrete point P1 are respectively measured as 217 and L1, and gray scale and the luminance value of the discrete point P2 are respectively measured as 220 and L2. Accordingly, gray scale of the non-discrete point P corresponding to the location point O is obtained by the following formula:

$$G = 217 + (220 - 217) \times \frac{L - L_1}{L_2 - L_1}.$$

In step S120, all the gray scales on the luminance characteristic curve corresponding to each luminance value are obtained and recorded on the luminance characteristic curve 1 based on the standard gamma curve 2, and the signal generator 20 determines whether all the location points on the standard gamma curve 2 have been measured. If all the location points have been located, step S122 is implemented. If not, step S114 is repeated.

In step S122, a gamma table is established. The gamma table of the display device 30 is generated by comparing the gray scales of the luminance characteristic curve and the standard gamma curve. All the gray scales stored in the signal generator 20 are arranged in order from smallest to largest, together constituting the gamma table. The gamma table is stored in the memory 32 of the display device 30.

In summary, the method as disclosed provides a luminance characteristic curve corresponding to a display device 30 using Bezier curve interpolation. A total of 1024 gray scales are reduced to a small number of sampling points, which are further divided into groups, each group including three or more sampling points and not more than the total of the sampling points. The sampling points in each group are control points for the Bezier curve operation to generate other gray scales. A standard gamma curve is used to locate the gray scales on the luminance characteristic curve with a same luminance value, such that the gamma table corresponding to the display device 30 is established. Thus, establishment of the luminance characteristic curve is not only efficient, but also highly accurate.

It is to be understood, however, that even though numerous characteristics and advantages of the exemplary disclosure have been set forth in the foregoing description, together with details of the structure and function of the exemplary disclosure, the disclosure is illustrative only, and changes may be made in detail, especially in matters of shape, size, and arrangement of parts within the principles of exemplary disclosure to the full extent indicated by the broad general meaning of the terms in which the appended claims are expressed.

What is claimed is:

1. A method of establishing a gamma table, the method comprising:

providing a signal generator, a display device, and a color analyzer, the display device for displaying images;

measuring luminance values of the images corresponding to a plurality of reference sampling points;

obtaining a luminance characteristic curve based on the reference sampling points and luminance values using Bezier curve interpolation;

locating gray scales on the luminance characteristic curve with the same luminance values as the gray scales of a standard gamma table; and establishing a gamma table by comparing the gray scales of the standard gamma curve and the luminance characteristic curve;

wherein the luminance values of the display device are measured by the color analyzer; and wherein obtaining a luminance characteristic curve based on the reference sampling points and luminance values using Bezier curve interpolation comprises:

dividing the sampling points into a plurality of control groups including M sampling points, M being a whole number and $3 \leq M \leq 2^n$, and $2 \leq n \leq 5$, and the initial sampling point of any one control group being the same as the final sampling point of the previous successive control group; and using M sampling points of each control group as control points for a M−1th Bezier curve and calculating the luminance values corresponding to 15 gray scales evenly spaced between two adjacent sampling points by the M−1th Bezier curve.

2. The method of establishing a gamma table as claimed in claim 1, wherein the gamma table is stored in the display device.

3. The method of establishing a gamma table as claimed in claim 1, wherein each control group includes 4 sampling points, and the 4 sampling points are used as the control of a cubic Bezier curve.

4. The method of establishing a gamma table as claimed in claim 1, wherein the step of locating the gray scales on the luminance characteristic curve with the same luminance values as the gray scales of a standard gamma table further comprises a step of using the standard gamma curve to sequentially find the gray scales on the luminance characteristic curve with the same luminance values.

5. The method of establishing a gamma table as claimed in claim 4, wherein the luminance characteristic curve includes a plurality of discrete points and the step of 5 locating the gray scales on the luminance characteristic curve with the same luminance values as the gray scales of a standard gamma table further comprises locating the nearest adjacent discrete points on the luminance characteristic curve corresponding to a location point on the standard gamma curve with the same luminance values.

6. The method of establishing a gamma table as claimed in claim 5, wherein the step of locating the gray scales on the luminance characteristic curve with the same luminance values as the gray scales of a standard gamma table further comprises obtaining the corresponding gray scales on the luminance characteristic curve using arithmetic interpolation.

7. The method of establishing a gamma table as claimed in claim 1, further comprising recording all the gray scales on the luminance characteristic curve corresponding to each luminance value.

8. The method of establishing a gamma table as claimed in claim 1, wherein the signal generator is respectively connected to the display device and the color analyzer and includes a register for storing different luminance values, and the display device includes a memory for storing the gamma table.

9. The method of establishing a gamma table as claimed in claim 8, wherein the signal generator sequentially provides a plurality of gamma voltage signals to the display device to generate images, and the color analyzer determines different luminance values of the images displayed on the display device and providing the luminance values to the register of the signal generator.

* * * * *